US008997382B2

(12) United States Patent
Gilmore et al.

(10) Patent No.: US 8,997,382 B2
(45) Date of Patent: Apr. 7, 2015

(54) DIPPER DOOR ASSEMBLY

(71) Applicant: Caterpillar Global Mining LLC, Oak Creek, WI (US)

(72) Inventors: Carl D. Gilmore, South Milwaukee, WI (US); Jeffrey Klingel, Delafield, WI (US); Kenneth J. Meyer, West Bend, WI (US); Zoran Marjanovic, Wind Lake, WI (US); Richard Hoppens, Milwaukee, WI (US); Jamie K. Sherwood, Edmonton (CA); Richard Alberts, Athabasca (CA); Russell J. Willmann, Milwaukee, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 187 days.

(21) Appl. No.: 13/752,702

(22) Filed: Jan. 29, 2013

(65) Prior Publication Data

US 2013/0192101 A1 Aug. 1, 2013

Related U.S. Application Data

(60) Provisional application No. 61/592,266, filed on Jan. 30, 2012, provisional application No. 61/697,157, filed on Sep. 5, 2012.

(51) Int. Cl.

| | |
|---|---|
| ***E02F 3/407*** | (2006.01) |
| ***E02F 3/40*** | (2006.01) |
| ***E02F 9/00*** | (2006.01) |

(52) U.S. Cl.

CPC ..... *E02F 3/4075* (2013.01); *E02F 3/40* (2013.01); *E02F 9/006* (2013.01)

(58) Field of Classification Search

CPC ..... E02F 3/40; E02F 3/407; E02F 3/40775; E02F 9/006

USPC ..... 37/443, 444, 445

See application file for complete search history.

(56) References Cited

U.S. PATENT DOCUMENTS 1,609,372 A * 12/1926 Lichtenberg ..... 414/726
1,629,634 A * 5/1927 Orndorff ..... 37/444

(Continued)

FOREIGN PATENT DOCUMENTS

JP 2010-185246 8/2010
JP 2011-252376 12/2011

OTHER PUBLICATIONS

International Search Report and Written Opinion for International Application No. PCT/US2013/023640, dated May 15, 2013, 13 pages.

(Continued)

*Primary Examiner* — Jamie L McGowan
(74) *Attorney, Agent, or Firm* — Foley & Lardner LLP

(57) ABSTRACT

A dipper assembly includes a dipper, a dipper door, a closure mechanism, a trip assembly, and a camshaft support assembly. The dipper door is pivotally mounted to the dipper for movement between an open position and a closed position in which the dipper door covers the dipper bottom. The closure mechanism is configured to retain the dipper door in the closed position. The trip assembly is configured to release the dipper door for movement to the open position, and includes a trip arm coupled to a camshaft and also coupled to a trip rope. The camshaft support assembly is configured to receive the camshaft, and includes a bearing block receiving a rotatable bearing member, and a sealing mechanism.

18 Claims, 18 Drawing Sheets

(56) References Cited

U.S. PATENT DOCUMENTS

| | | | | |
|---|---|---|---|---|
| 1,637,689 | A | 8/1927 | Endersby | |
| 1,725,858 | A * | 8/1929 | Joseph et al. | 292/97 |
| 2,160,432 | A | 5/1939 | Davidson | |
| 2,335,352 | A | 11/1943 | Murtaugh | |
| 3,059,793 | A * | 10/1962 | Atkinson et al. | 414/726 |
| 3,690,483 | A | 9/1972 | Kraschnewski et al. | |
| 4,282,664 | A | 8/1981 | Thiele et al. | |
| 4,509,233 | A | 4/1985 | Shaw | |
| 4,517,756 | A | 5/1985 | Olds et al. | |
| 4,720,234 | A | 1/1988 | Stralow | |
| 5,499,463 | A * | 3/1996 | Profio et al. | 37/398 |
| 5,613,308 | A | 3/1997 | Little | |
| 5,619,810 | A | 4/1997 | Kasim | |
| 5,815,958 | A | 10/1998 | Olds et al. | |
| 6,219,946 | B1 | 4/2001 | Soczka | |
| 6,467,202 | B1 | 10/2002 | Brown, Jr. | |
| 7,096,610 | B1 | 8/2006 | Gilmore | |
| 7,617,619 | B2 | 11/2009 | Cox | |
| D615,006 | S | 5/2010 | Goodman et al. | |
| 8,844,174 | B2 * | 9/2014 | Hren et al. | 37/445 |
| 2011/0146114 | A1 | 6/2011 | Hren et al. | |
| 2011/0214317 | A1 * | 9/2011 | Wurster | 37/397 |
| 2012/0192465 | A1 * | 8/2012 | Opazo | 37/444 |
| 2013/0192099 | A1 * | 8/2013 | Gilmore et al. | 37/445 |
| 2013/0192100 | A1 * | 8/2013 | Gilmore et al. | 37/445 |
| 2013/0192101 | A1 * | 8/2013 | Gilmore et al. | 37/445 |

OTHER PUBLICATIONS

International Search Report and Written Opinion for International Application No. PCT/US2013/023648, dated May 14, 2013, 11 pages.

International Search Report and Written Opinion for International Application No. PCT/US2013/023663, dated May 15, 2013, 12 pages.

International Preliminary Report on Patentability for PCT Application No. PCT/US2013/023640, dated Aug. 5, 2014, 8 pages.

International Preliminary Report on Patentability for PCT Application No. PCT/US2013/023648, dated Aug. 5, 2014, 8 pages.

International Preliminary Report on Patentability for PCT Application No. PCT/US2013023663, dated Aug. 5, 2014, 7 pages.

* cited by examiner

DIPPER DOOR ASSEMBLY

CROSS-REFERENCE TO RELATED APPLICATIONS

This application claims the benefit of priority to U.S. Provisional Patent Application No. 61/592,266, which was filed on Jan. 30, 2012, and to U.S. Provisional Patent Application No. 61/697,157, which was filed on Sep. 5, 2012, the complete disclosures of which are incorporated by reference herein.

TECHNICAL FIELD

This disclosure relates to dippers for large mining shovels, and particularly to a dipper assembly including a closure mechanism that locks a dipper door in a closed position closing the bottom of the dipper.

BACKGROUND

Shovel dippers are formed with teeth at their leading edge and a dipper door that normally closes the rear of the dipper to hold earth and other materials that are loaded into the dipper by the action of the shovel. The dipper door must be held closed while the dipper is being loaded and while the load in the dipper is swung to a deposit point. At that point, the dipper door is opened to allow the contents of the dipper to empty. Typically, the locking of the dipper door has been accomplished by a mechanical latch proximal a cutting face of the dipper. The mechanical latch holds the door in a closed position, and is released by a cable or trip wire rope to allow the door to swing open under its own weight and the weight of the contents of the dipper. The door is relatched by allowing it to swing closed by virtue of its own weight and the changing attitude of the dipper as the dipper rotates back in preparation for its next loading cycle. An example of such a mechanical latch is found in U.S. Pat. No. 5,815,958 issued Oct. 6, 1998, for "Excavator Dipper Latch Assembly Having Removable Tapered Latch Bar."

The existing latching mechanisms include a latching keeper and striking plate which is typically located on the front wall of the dipper in order to engage a latch bar mounted within the confines of the dipper door. The front wall of the dipper forms the cutting face of the dipper and is subjected to extreme abuse as the dipper cuts into the earth. The existing mechanical latching mechanisms are subjected to false door release or failure to latch due to fouling caused by rocks and dirt being lodged into the latchkeeper mechanism. Moreover, the constant abuse caused by the latch mechanism being located in the path of material flow results in excessive wear and resulting high maintenance costs and efforts.

SUMMARY OF THE INVENTION

An embodiment of the present disclosure relates to a dipper assembly for a mining shovel. The dipper assembly includes a dipper having a dipper back and an open dipper bottom, a dipper door coupled to the dipper for movement between an open position and a closed position, a closure mechanism configured to retain the dipper door in the closed position, a trip assembly configured to release the dipper door for movement to the open position, and a camshaft support assembly.

In this embodiment, the trip assembly includes a camshaft having a cam, the camshaft and cam configured to rotate in response to a force, and the cam being configured to engage the closure mechanism when rotated. The trip assembly also includes a trip arm coupled to the camshaft and also coupled to a trip rope, the trip arm configured to rotate the camshaft and cam when activated by the trip rope. The closure mechanism is configured to release the dipper door engaged by the cam. The camshaft support assembly includes a bearing block having a socket configured to receive a rotatable bearing member, the rotatable bearing member received by the socket of the bearing block and having a bore configured to receive the camshaft. The camshaft support assembly also includes a sealing mechanism positioned between the bearing block and the rotatable bearing member, and configured to provide a seal between the bearing block and the rotatable bearing member.

Another embodiment of the present disclosure relates to a camshaft support assembly for a shovel dipper. The camshaft support assembly includes a bearing block coupled to the shovel dipper and having a socket configured to receive a rotatable bearing member, a rotatable bearing member received by the socket of the bearing block and having a bore configured to receive a camshaft, the camshaft having a cam configured to release a dipper door on the shovel dipper. The camshaft support assembly also includes a sealing mechanism positioned between the bearing block and the rotatable bearing member, and configured to provide a seal between the bearing block and the rotatable bearing member.

Another embodiment of the present disclosure relates to a trip assembly for a shovel dipper having a dipper door. The trip assembly includes a camshaft having a cam configured to release the dipper door, a trip arm having a first end coupled to the camshaft and a second end coupled to a trip rope, the trip arm configured to move in response to a force applied by the trip rope, rotating the camshaft and cam, and allowing the dipper door to open, and a Y-shaped link having a first end coupled to a connector, and having a second end coupled to the trip arm. In this embodiment, the connector has a first end coupled to the Y-shaped link and a second end coupled to the trip rope.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
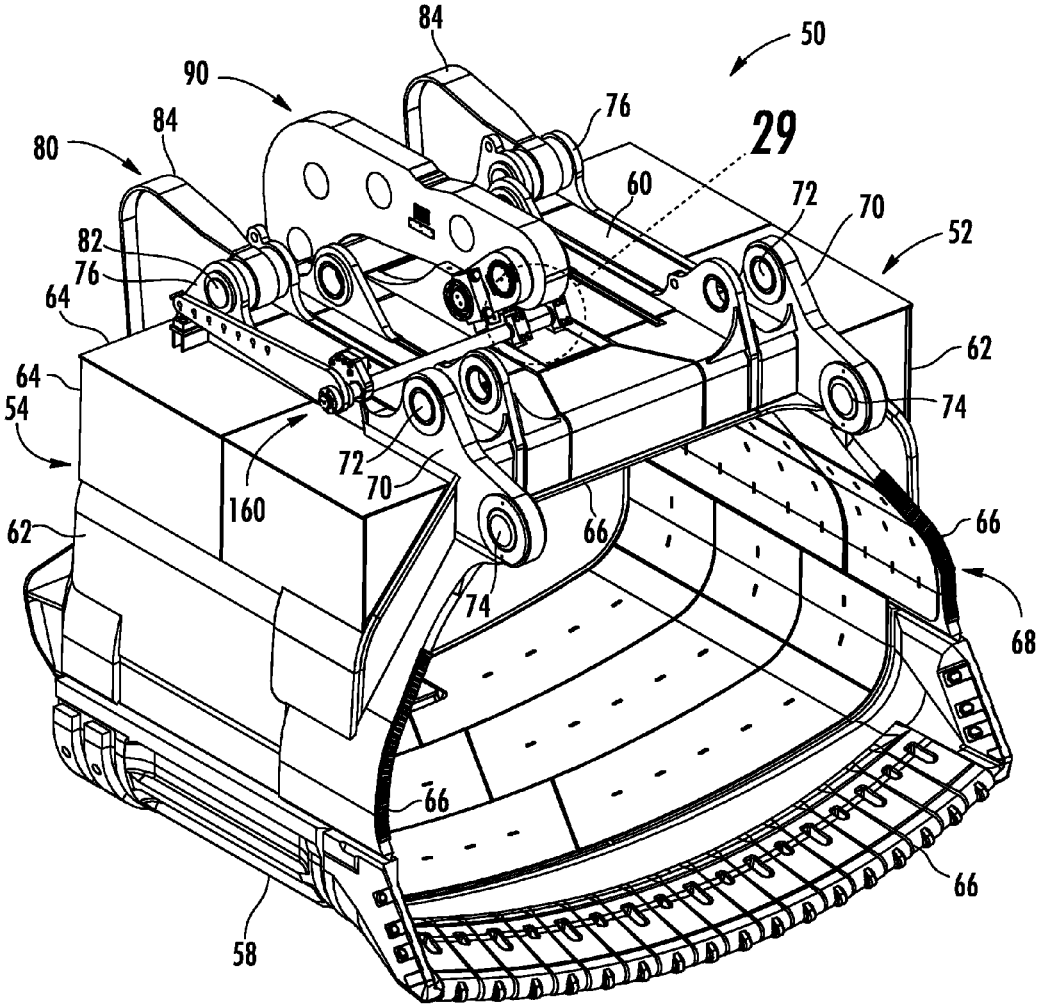
FIG. 1 is a perspective view of a dipper assembly with a dipper door in a closed position, in accordance with an exemplary embodiment.
Figure 2:
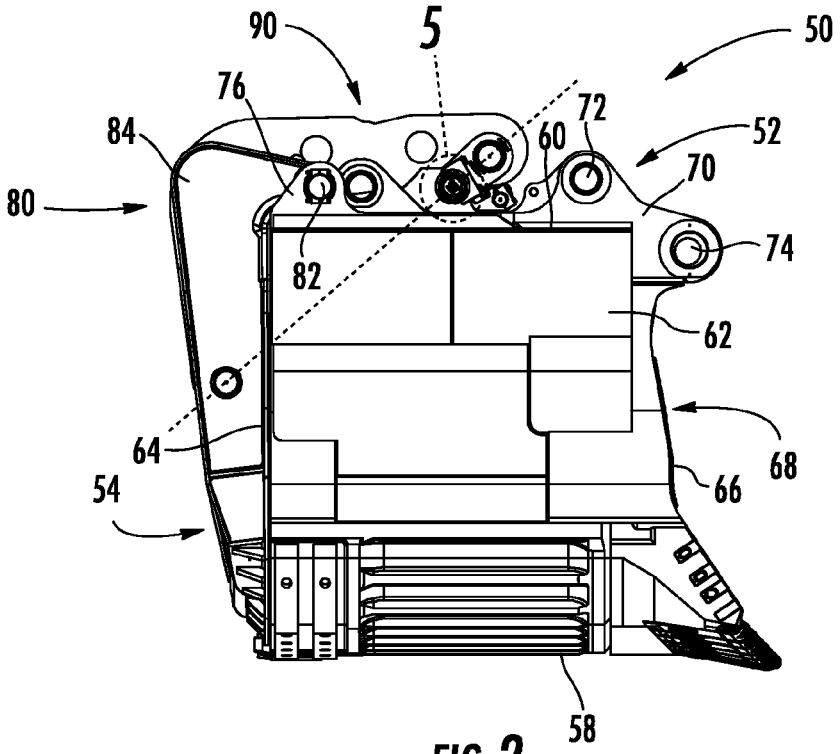
FIG. 2 is a side view of the dipper assembly of FIG. 1.
Figure 3:
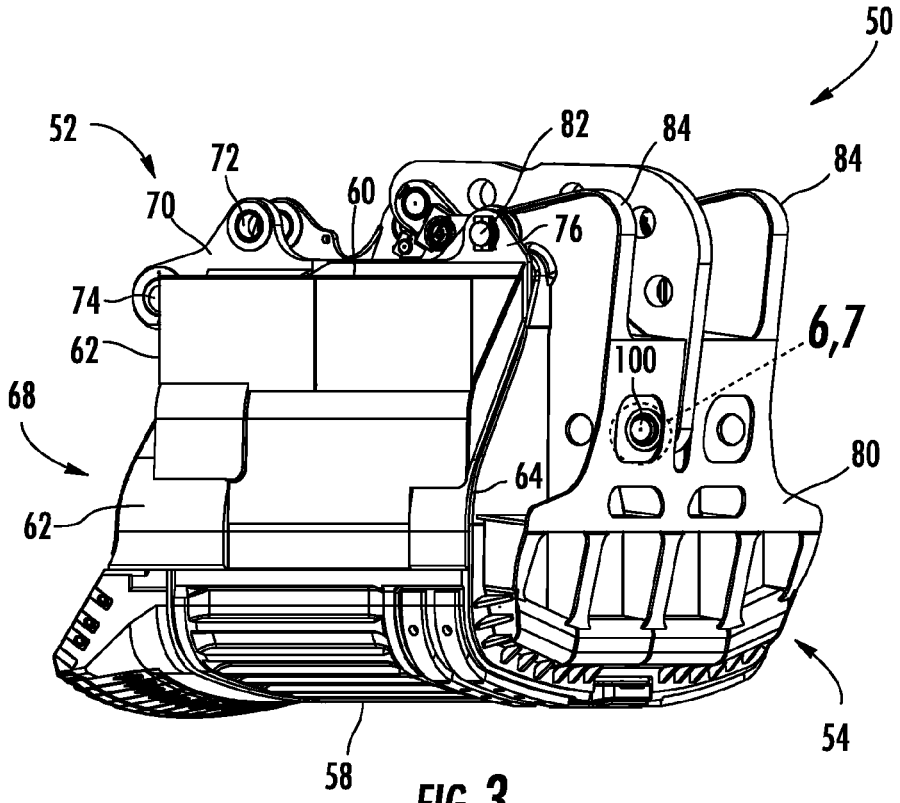
FIG. 3 is another perspective view of the dipper assembly of FIG. 1.

Referring to FIGS. 1-3, a dipper assembly 50 includes a dipper 52 having an open dipper bottom 54. A front wall 58 is coupled to a back wall 60 with side walls 62. Rearward edges 64 of the walls 58, 60, and 62 define the open dipper bottom 54. Forward edges 66 of the walls 58, 60, and 62 define an open forward end 68 of the dipper 52 through which the dipper 52 is filled. Teeth may be provided on the forward edge 66 of the front wall 58 to define a cutting edge that cuts into the ground to fill the dipper 52.

The open bottom 54 is closed by a pivotally mounted dipper door 80. The dipper door 80 is locked in a closed position covering the open dipper bottom 54 by a continuously engaged closure mechanism 90. The closure mechanism 90 is mounted away from a cutting face (e.g., the front wall 58) of the dipper 52 which minimizes fouling by dirt forced into the closure mechanism 90 as the dipper 52 cuts into the ground.

The dipper back wall 60 includes mounting structures with which the dipper assembly 50 is coupled to a dipper handle (not shown) extending from a shovel (not shown). Dipper mounting lugs 70 extending from the dipper back wall 60 proximate to the back wall forward edge 66 include dipper handle bores 72 that receive mounting pins (not shown) to mount the dipper 52 to the dipper handle and padlock bores 74. Dipper door mounting lugs 76 extending from the back wall 60 proximate to the back wall rearward edge 64 include door hinge bores 78 (see FIG. 9) that receive pivot pins 82 to couple the dipper door 80 to the dipper 52 for pivotal movement.

The dipper door 80 is pivotally connected to the dipper 52 and abuts the rearward edges 64 of the dipper walls 58, 60, and 62 to close the dipper bottom 54. A pair of L-shaped dipper door lugs 84 extend from the dipper door 80 past the dipper back wall 60 rearward edge 64. The door lugs 84 are each coupled to the dipper door mounting lugs 76 with a pivot pin 82. Although a substantially planar dipper door 80 is disclosed, in other embodiments, the dipper door 80 may define a volume which abuts the dipper 52 to close the dipper bottom 54 or may extend into a volume defined by the dipper walls 58, 60, and 62 to close the open dipper bottom 54.

Figure 47:
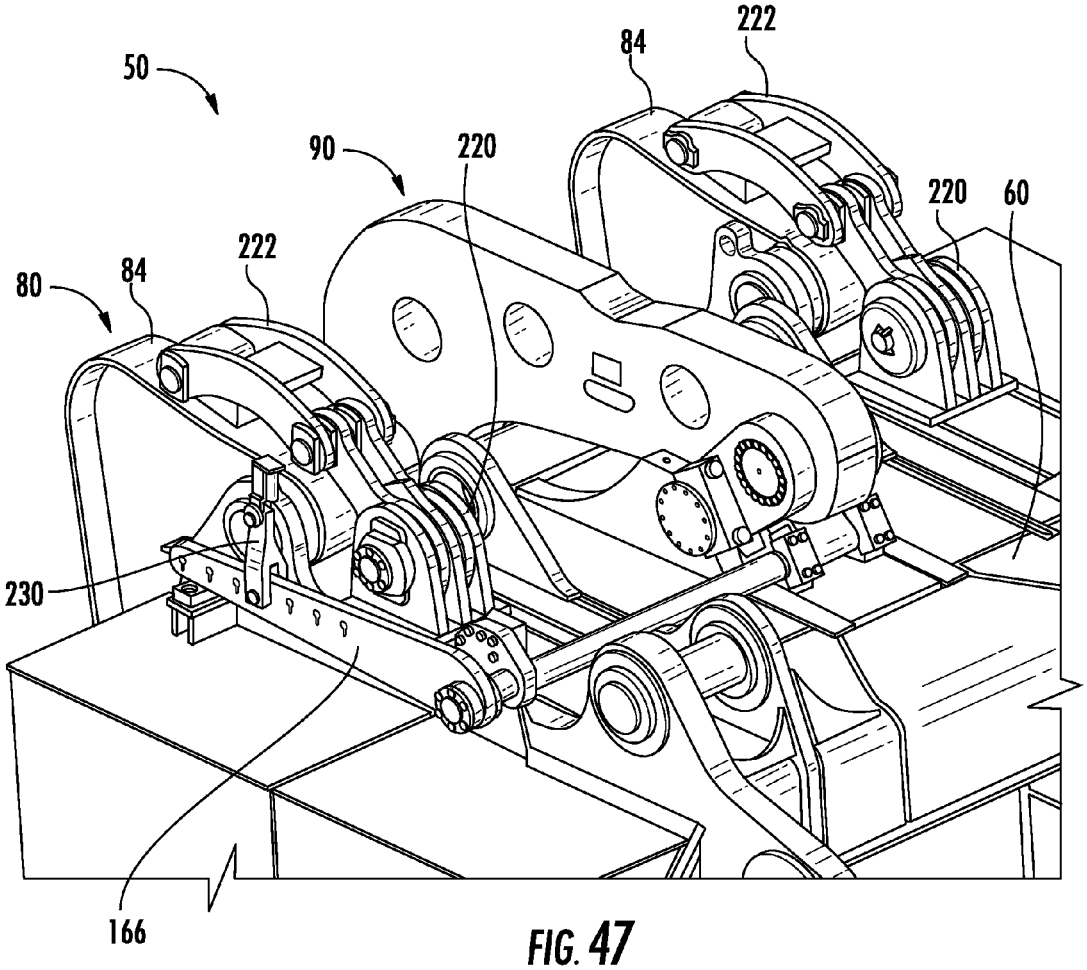
FIG. 47 is a partial perspective view of a dipper assembly showing snubbers coupled to a dipper door, in accordance with an exemplary embodiment.

The dipper door 80 is locked in the closed position by the closure mechanism 90 in a locked position, as shown in FIGS. 1-3. When the closure mechanism 90 is moved to an unlocked position, the dipper door 80 freely pivots about the pivot pins 82 and freely swings away from the open dipper bottom 54 toward an open position to discharge the load in the dipper 52. As shown in FIG. 47, devices such as snubbers 220 may be coupled to the dipper back wall 60 with snubber links 222 and engage the dipper door lugs 84 to dampen the free swinging motion of the dipper door 80 as the dipper door 80 swings from the open position toward the closed position.

Figure 4:
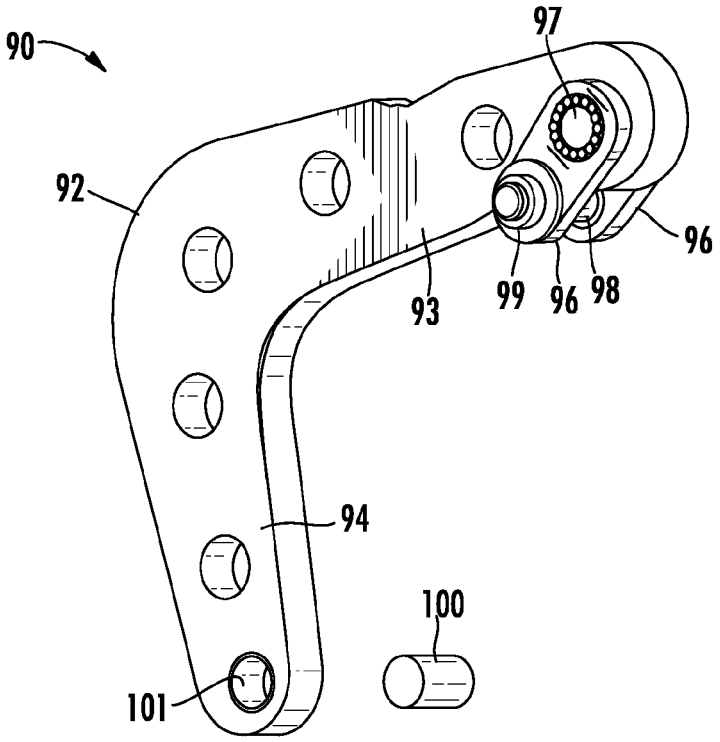
FIG. 4 is a perspective view of a closure mechanism for the dipper assembly of FIG. 1, in accordance with an exemplary embodiment.

Referring now to FIG. 4, the closure mechanism 90 includes an L-shaped link 92 moveable between a locked position in which the link 92 holds the dipper door 80 in the closed position and an unlocked position in which the link 92 allows the dipper door 80 to pivot about the pivot pins 82 away from the open dipper bottom 54. The L-shaped link 92 has a first leg 93 and a second leg 94 oriented at an angle relative to the first leg 93 When the dipper door 80 is in the closed position, the first leg 93 extends along the dipper back wall 60 and the second leg 94 extends along the dipper door 80. The first leg 93 of the L-shaped link 92 is coupled to eccentric link side plates 96. The second leg 94 is pivotably coupled to the dipper door 80 with a cylindrical pin 100 (see FIG. 6) or an eccentric pin assembly 104 (see FIG. 8).

Figure 5:
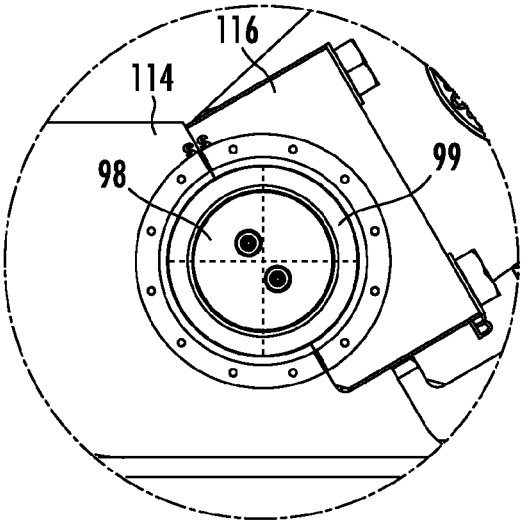
FIG. 5 is a detail side view of a mounting bracket for an eccentric link of the closure mechanism of FIG. 4, in accordance with an exemplary embodiment.

Eccentric link side plates 96 are provided on either side of the distal end of the first leg 93 of the L-shaped link 92 and are pivotably coupled to the link 92 with a pin 97. The opposite ends of the eccentric link side plates 96 are joined together by an eccentric link shaft 98. The pin 97 is radially offset from, and parallel to, the eccentric link shaft 98 and is fixed relative to eccentric link shaft 98 by the eccentric link side plates 96. As shown in FIG. 5, the eccentric link shaft 98 is coupled to eccentric link mounts 114 on the dipper back 60 with bearing caps 116. The eccentric link shaft 98 and the eccentric link side plates 96 rotate to move the pin 97 a limited arc distance between a locked position and an unlocked position. In the locked position, the pin 97 is spaced a first distance away from the rearward edge 64 and a first distance above the dipper back wall 60 to position the L-shaped link 92 forward and move the dipper door 80 substantially parallel to and slightly separated from the dipper 52 to close the open dipper bottom 54. In the locked position, the closure mechanism 90 does not allow the dipper door 80 to pivot relative to the dipper 52 and swing freely away from the closed position. In the unlocked position, the pin 97 is spaced a second distance away from the rearward edge 64 and a second distance above the dipper back wall 60 to move the L-shaped link 92 rearward and allow the dipper door 80 to pivot relative to the dipper 52 and swing freely away from the closed position toward the open position. The first distance is greater than the second distance, such that in the locked position, the L-shaped link 92 is in tension to hold the dipper door 80 in the closed position.

Figure 6:
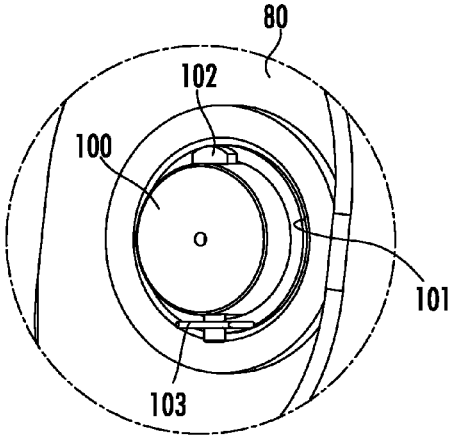
FIG. 6 is a detail back perspective view of a closure mechanism coupled to a dipper door with a cylindrical bushing, in accordance with an exemplary embodiment.

Referring now to FIG. 6, the second leg 94 is pivotably coupled to the dipper door 80 with a cylindrical pin 100. The pin 100, is received in apertures 101 in the body of the dipper door 80 and the second leg 94 and retained in the apertures 101 with a locking device such as a T-bolt 102 and a pin 103 (e.g., hair pin, cotter pin, R-clip, linchpin, etc.). According to an exemplary embodiment, the pin 100 has a clearance in the apertures 101 of greater than 6% of the diameter of the pin 100. A clearance of greater than 6% of the pin diameter is believed to reduce link bushing loading following impacts between the dipper door 80 and surrounding machinery. For example, when brought back to close the dipper door 80 and start a digging pass near the front of the shovel, the dipper assembly 50 may impact the crawler. In other exemplary embodiments, the pin 100 may have a clearance in the apertures 101 of less than 6% of the diameter of the pin 100.

Figure 7:
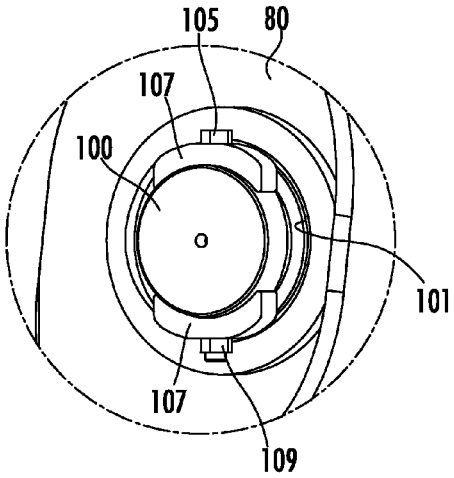
FIG. 7 is a detail back perspective view of an alternative closure mechanism coupled to a dipper door with a cylindrical bushing, in accordance with an exemplary embodiment.

Referring now to FIG. 7, another embodiment of the pin assembly of FIG. 6 is shown, for readily connecting second leg 94 to the dipper door 80. In this embodiment, the pin assembly includes a drilled connecting shaft 105, custom retaining blocks 107 shown having a contour adapted to fit on pin 100, and locking hardware 109. The pin 100 is received in apertures 101 in the body of the dipper door 80 and the second leg 94 and retained in the apertures 101. Drilled connecting shaft 105 connects pin 100 to custom retaining blocks 107 and the assembly is retained by locking hardware 109 (e.g., threaded fastener, etc.). This embodiment is intended to provide clearance between pin 100, the door bushing, and the link bushing in the event of a link strike by the dipper. According to one embodiment, pin 100 may have a diameter of approximately 7.625 inches, connecting shaft 105 may have a diameter of approximately 1 inch and a length of approximately 11 inches, and retaining blocks 107 may have a thickness of at least approximately 1 inch. However, other dimensions may be used in other embodiments. Further, the pin assembly is intended to be able to be installed, replaced and repaired with standard tools, rather than by the use of a torch or other heating mechanism.

Figure 8:
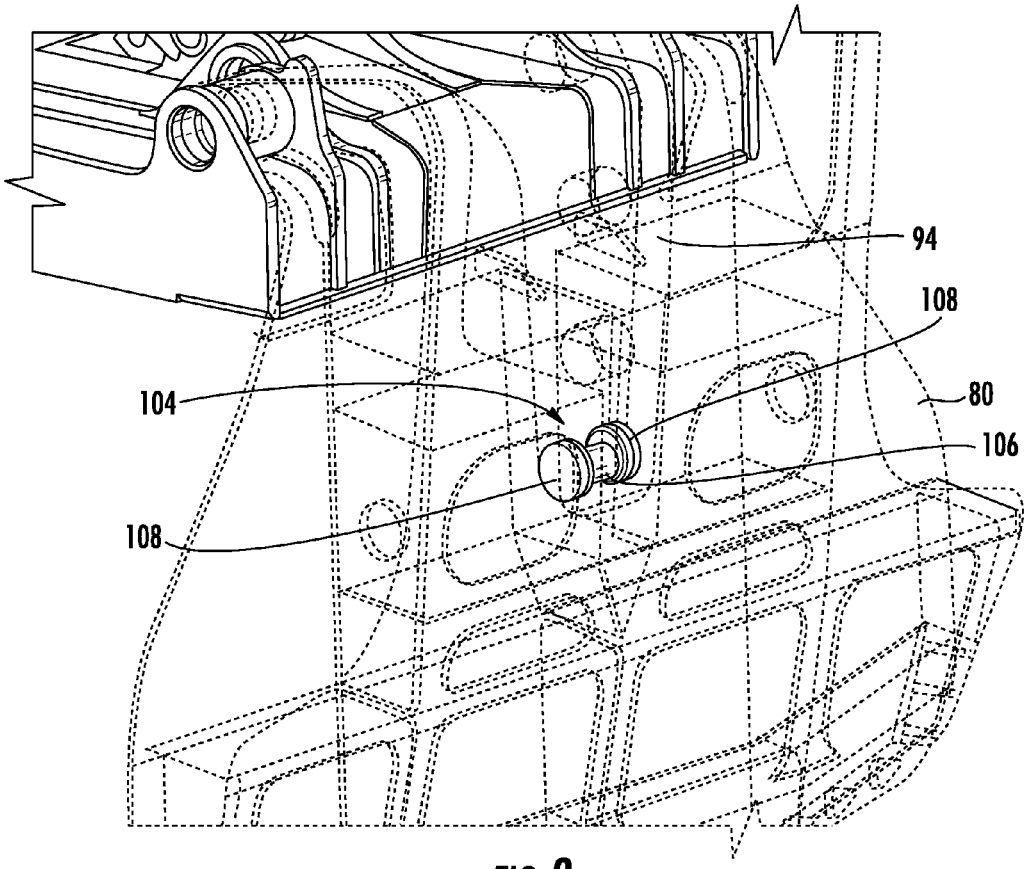
FIG. 8 is a partial back perspective view of a closure mechanism coupled to a dipper door with an eccentric bushing, with the dipper door in a closed position, in accordance with an exemplary embodiment.

Referring now to FIG. 8, in another embodiment, the second leg 94 may be pivotably coupled to the dipper door 80 with an eccentric pin assembly 104. The pin assembly 104 includes an inner portion 106 with a first diameter and eccentric outer portions 108 with a second diameter. According to an exemplary embodiment, the diameter of the inner portion 106 is less than the diameter of the outer portions 108. The inner portion 106 is received in an aperture in the second leg 94 of the L-shaped link 92 while the outer portions 108 are received in apertures 101 in the body of the dipper door 80. As described above, the apertures 101 may have a clearance of less than 6% of the pin diameter about the inner portion 106 and outer portions 108, respectively. The outer portion may include a feature such as a bolt circle to fix the rotational orientation of the pin assembly 104 relative to the dipper door 80. Because the inner portion 106 is not concentric with the outer portions 108, a rotation of the pin assembly 104 adjusts the position of the inner portion 106 relative to the outer portions 108 and therefore adjusts the position of the L-shaped link 92 relative to the dipper door 80 through the interaction of the dipper door 80, the link 92 and the pin assembly 104. The change in position of the L-shaped link 92, in turn, adjusts the over-center angle of the eccentric link side plates 96 coupled to the first leg 93 of the link 92 and the sensitivity of the closure mechanism 90. By adjusting the position of the L-shaped link 92 at the pinned connection, the over-center angle of the eccentric link side plates 96 may be changed from ground level, without accessing the stop block assemblies 130 on the dipper back, as will be described below.

Figure 9:
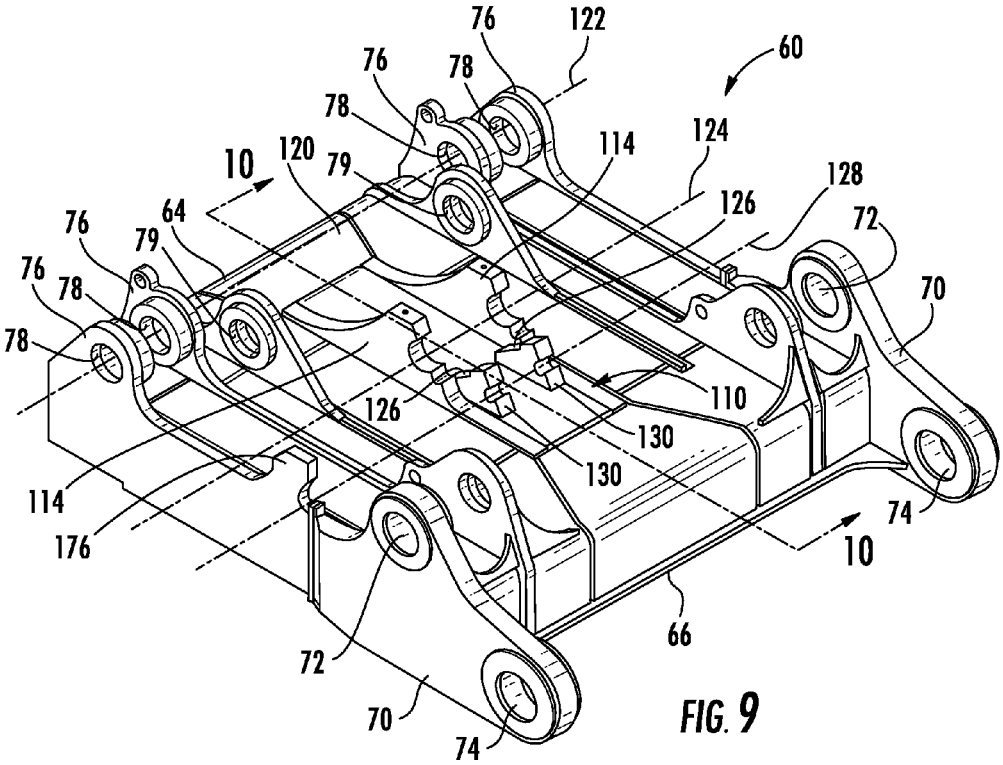
FIG. 9 is a perspective view of the dipper back for the dipper assembly of FIG. 1, in accordance with an exemplary embodiment.
Figure 10:
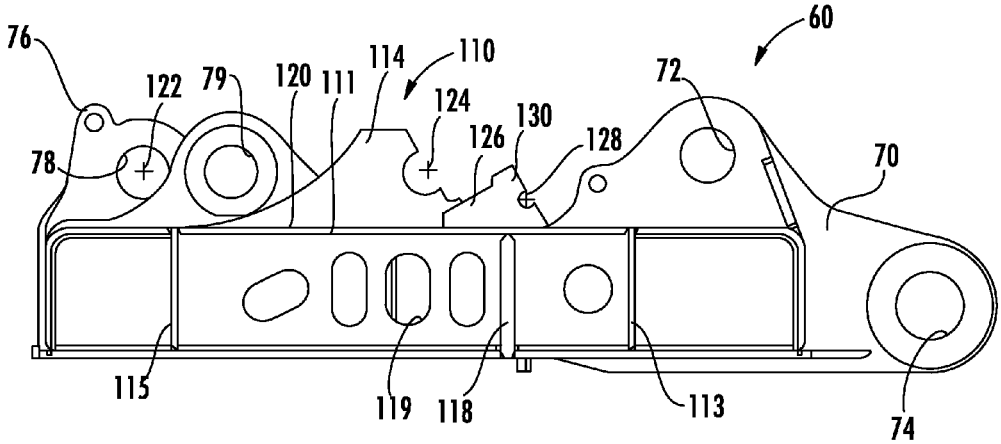
FIG. 10 is a cross-section view of the dipper back of FIG. 9, taken along line 10-10.
Figure 11:
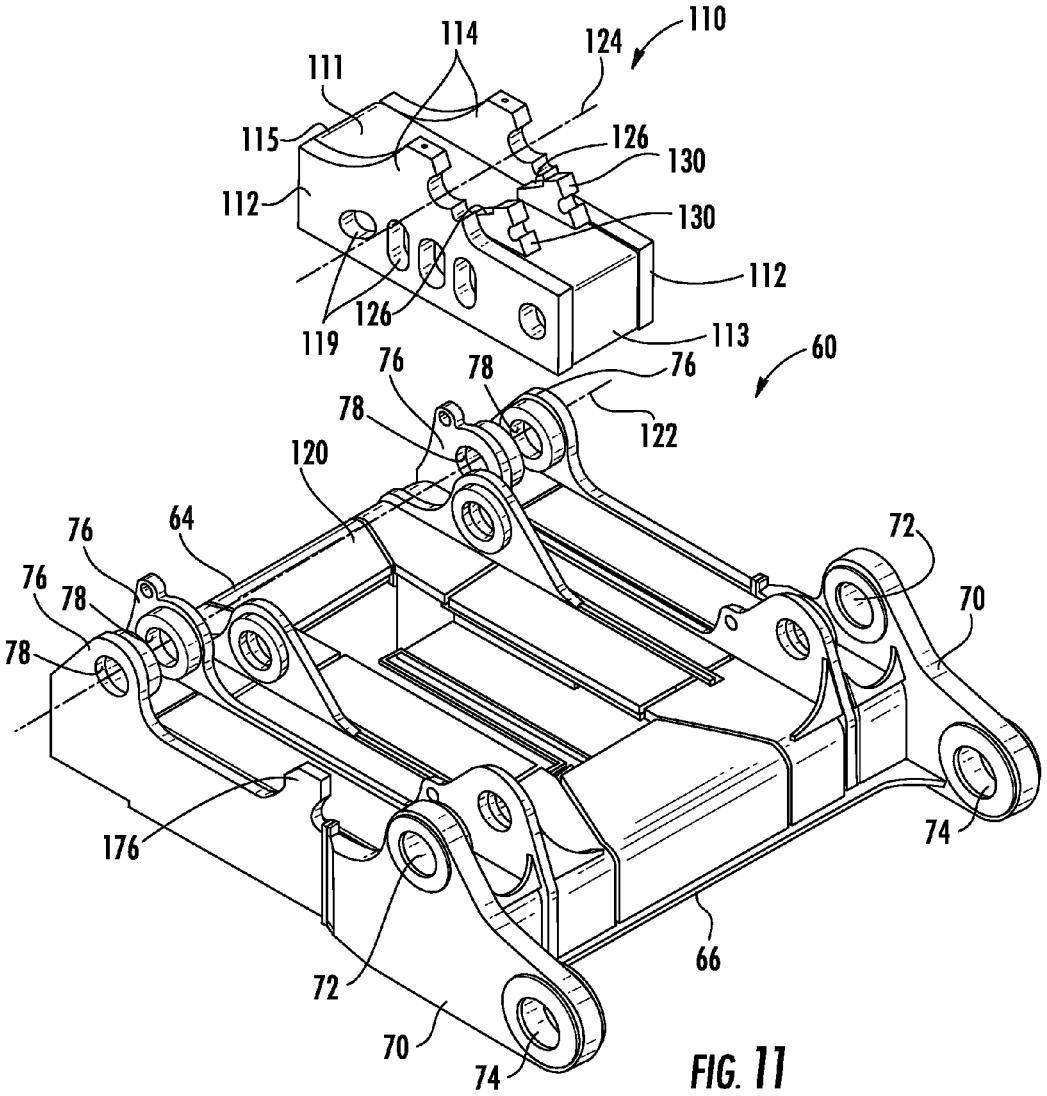
FIG. 11 is an exploded perspective view of the dipper back of FIG. 9.
Figure 12:
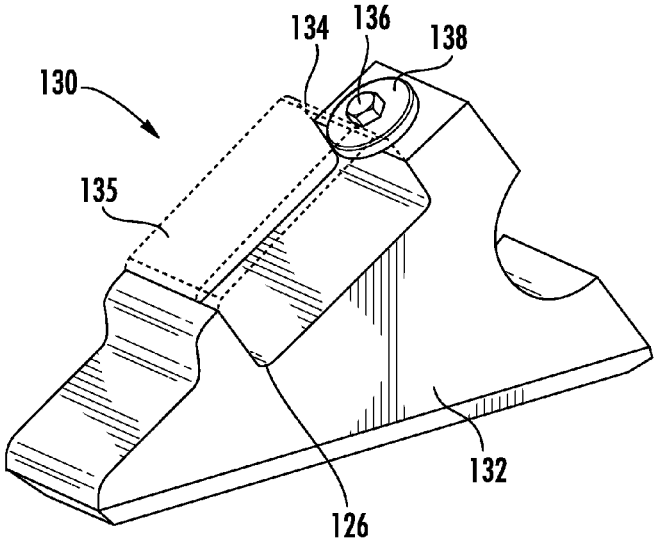
FIG. 12 is a perspective view of a stop block assembly for the dipper assembly of FIG. 1, in accordance with an exemplary embodiment.

Referring now to FIGS. 9-11, the dipper back 60 is shown in more detail. According to an exemplary embodiment, the dipper back 60 includes a central sub-weldment 110 extending the entire depth of the dipper back 60. The sub-weldment 110 is a box-like structure with a top 111, a pair of side walls 112 extending downward from the top 111, a front 113, and a back 115. The side walls 112 form the eccentric link mounts 114, which are configured to receive the bearings 99 coupled to the eccentric link shaft 98. The eccentric link shaft 98 is retained on the mounts 114 with bearing caps 116, which are fastened to the pin mounts 114, such as with a bolted connection, as shown in FIG. 5. The sub-weldment 110 further includes a pair of stop block assemblies 130. A stop assembly 130 is aligned with each of the eccentric link side plates 96 to provide contact surfaces for the eccentric link side plates 96, limiting the rotation of the eccentric link side plates 96 to a predefined over-center angle. The stop block assemblies 130 thereby limit the forward travel of the L-shaped link 92 and define the first distance of the pin 97 relative to the rearward edge 64 of the dipper back wall 60.

The sub-weldment 110 is configured to extend the entire depth of the dipper back 60, as shown in FIG. 10. One or more support members, such as a gusset 118 may be provided to better support loads applied to the sub-weldment 110 by the closure mechanism 90 and direct the applied loads to dipper back connection pins (not shown). The side walls 112 may include apertures 119 to decrease the overall mass of the sub-weldment 110.

Preferably, the closure mechanism 90 is self-locking by locating the locked position of the eccentric link side plates 96 past an over-center position, such that a line extending through the longitudinal axis of the pins 97 and the longitudinal axis of the pin 100 (or the longitudinal axis of inner portion 106 of an eccentric pin assembly 104) passes between the axis of rotation of the eccentric link shaft 98 and the dipper back wall 60. As a result, the weight of the dipper door 80 holds the eccentric link side plates 96 against the stop block assemblies 130 until the L-shaped link 92 is rotated to move the pin 97 away from the dipper back wall 60 back over the over-center position toward the unlocked position and allow the dipper door 80 to pivot relative to the dipper 52. Once the eccentric link side plates 96 are urged back over the over-center position toward the unlocked position, such that the axis of rotation of the eccentric link shaft 98 passes between the line extending through the longitudinal axis of the pins 97 and the longitudinal axis of the pin 100 (or the longitudinal axis of inner portion 106 of an eccentric pin assembly 104) and the dipper back wall 60, the weight of the dipper door 80 and the contents of the dipper 52 opens the dipper door 80 without further external forces.

The dipper back 60 and the sub-weldment 110 are assembled such that a multitude of interrelated bores and surfaces may be machined on a single manufacturing fixture, decreasing the opportunities for misalignments and errors due to stacked tolerances or welding distortion that may occur if components are separately machined and assembled in the field. According to an exemplary embodiment, a datum is established by the top surface 120 of the dipper back 60 and the longitudinal axis 122 of the door hinge bores 78, about which the dipper door 80 pivots on the pivot pins 82. The longitudinal axis 124 of the bores for the eccentric link shaft 98 as defined by the mounts 114 and bearing caps 116 is located relative to the door hinge pin axis 122. Sockets 126 (e.g., hollows, mounting surfaces, pockets, etc.) in the stop block assemblies 130 are located relative to the door hinge pin axis 122 or the eccentric link shaft axis 124. The longitudinal axis 128 of the bores for the camshaft 164 as defined by the stop block assemblies 130 and inboard camshaft bearing caps 174 (see FIG. 28) are located relative to the door hinge pin axis 122, the eccentric link shaft axis 124, or the sockets 126.

Other machined features, such as the dipper handle bores 72, the padlock bores 74, and the pitch brace bores 79 may be located relative to the datum established by the top surface 120 of the dipper back 60 and the longitudinal axis 122 of the door hinge bores 78 or may be machined separately without substantially affecting the operation of the closure mechanism 90.

Referring now to FIGS. 12-25, the stop block assemblies 130 provide a contact surface 135 for the eccentric link side plates 96, limiting the rotation of the eccentric link side plates 96 to a predefined over-center angle, thereby at least partially setting the sensitivity of the closure mechanism 90. According to an exemplary embodiment, the stop block assembly 130 includes support frame 132 (e.g., base, bearing mount, etc.) configured to support the camshaft 164, as described below. Instead of being a solid member that is welded to the dipper back wall 60 and must be ground off, the frame 132 includes a machined socket 126 that receives an insert or stop block 134, the contact surface 135 provided by the outer face of the stop block 134. The thickness of the stop block 134 determines the location of the contact surface 135 relative to the machined socket 126. The position of the contact surface 135 and the resulting over-center angle may therefore be adjusted by replacing the stop block 134 with a differently sized block. The stop block 134 is configured to be a wearable element and is formed of a softer material than the eccentric link side plate 96 and the frame 132. According to one exemplary embodiment, the stop block 134 is formed from medium strength steel.

As shown in FIGS. 12-18, a bolt 136 may be oriented at an angle, substantially perpendicular to an angled face of the frame 132 and the angled contact surface 135 of the stop block 134. According to one exemplary embodiment, the bolt is oriented at a 30 degree angle from vertical. This angle allows the threaded hole in the frame 132 to be drilled and tapped using the same fixture as is utilized when machining other portions of the dipper back 60 (e.g., bores 78, sockets 126, etc.). As shown in FIGS. 19-25, in other embodiments, the stop block 134 may be coupled to the frame 132 with bolts 136 that are parallel to the contact surface 135.

Figure 13:
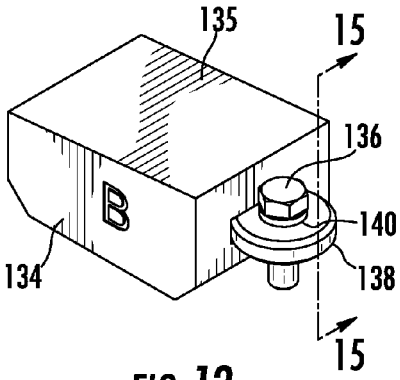
FIG. 13 is a perspective view of the stop block and fastening hardware for the stop block assembly of FIG. 12.
Figure 14:
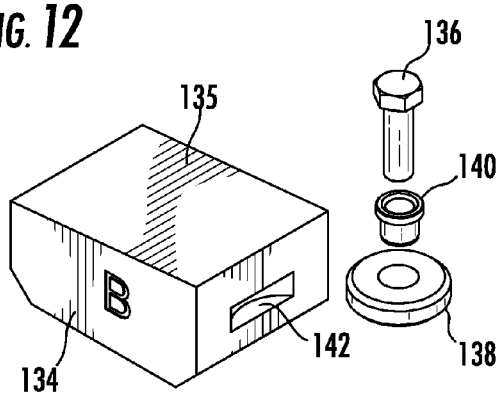
FIG. 14 is an exploded perspective view of the stop block and fastening hardware for the stop block assembly of FIG. 12.
Figure 15:
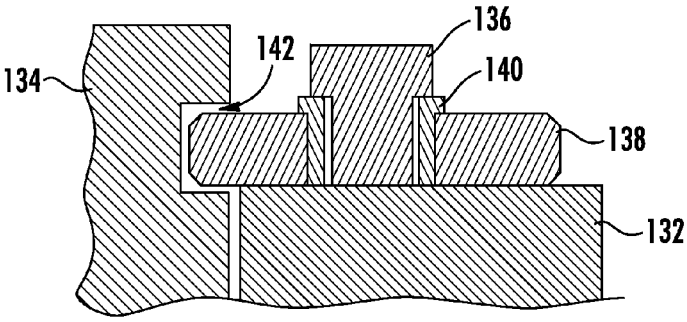
FIG. 15 is a cross-section view of the stop block and fastening hardware for the stop block assembly of FIG. 12, taken along line 15-15.

Referring now to FIGS. 13-15, the stop block 134 is coupled to the frame 132 with mounting hardware, such as a bolt 136 and, a washer 138 and a bushing 140. According to one exemplary embodiment, the bolt 136 is threadibly coupled to the frame 132 and the edge of the washer 138 is received in a slot 142 in the side of the stop block 134. The bolt 136 is therefore coupled to the stop block 134 indirectly through the interconnection of the bolt 136, the washer 138, the bushing 140, and the stop block 134. The indirect coupling and clearances between components (e.g., between the stop block 134 and the frame 132, between the stop block 134 and the washer 138, etc.) allows the bolt 136 to be at least partially shielded from impact forces experienced by the stop block 134 when it is contacted by the eccentric link side plate 96. The bolt 136, the washer 138, and the bushing 140 are configured as common hardware to be easily replaceable on-site if one of the mounting hardware is damaged or fails.

Figure 16:
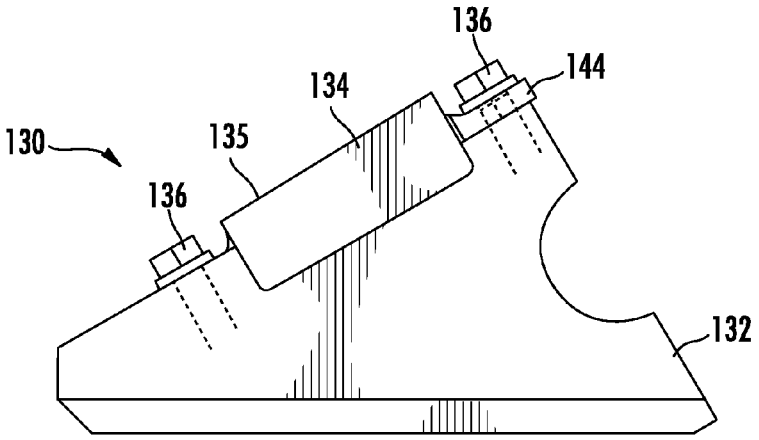
FIG. 16 is a side view of another stop block assembly, in accordance with an exemplary embodiment.
Figure 17:
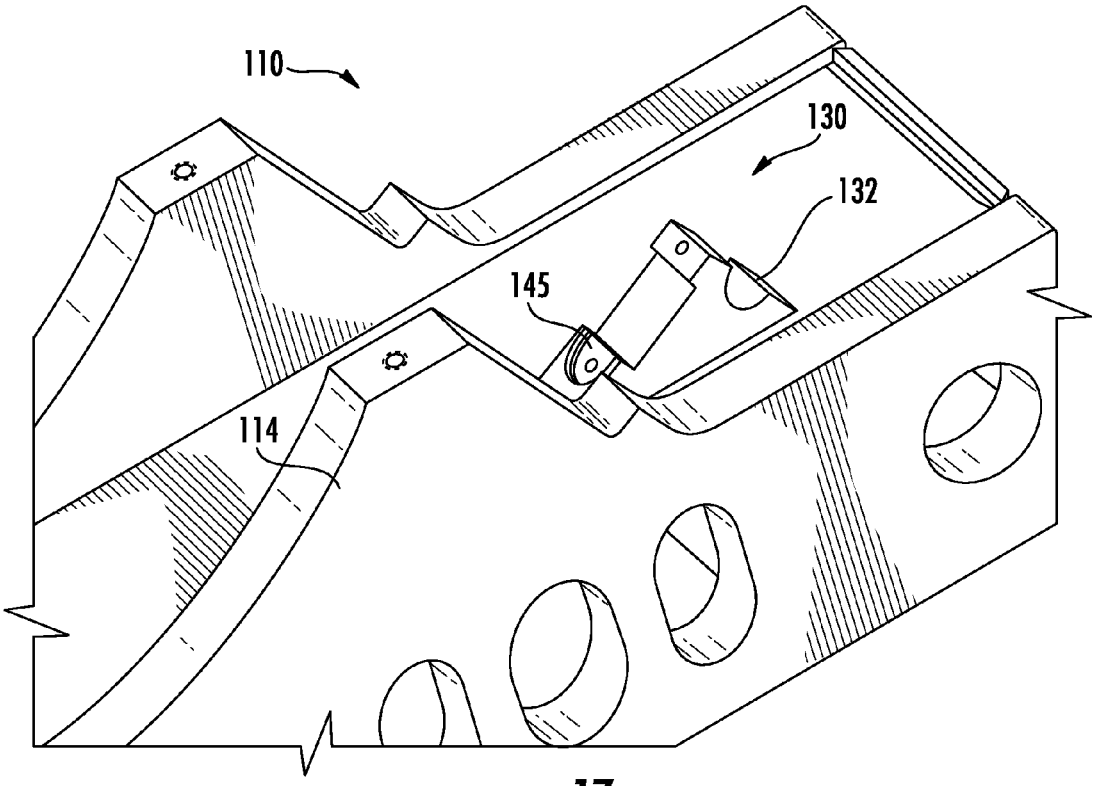
FIG. 17 is a perspective view of the stop block assembly of FIG. 16 coupled to a portion of a dipper back.
Figure 18:
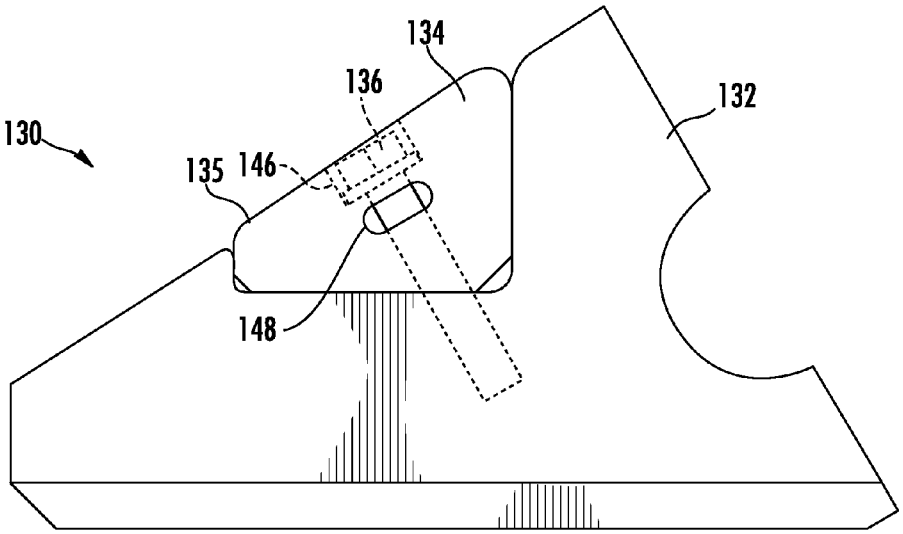
FIG. 18 is a side view of another stop block assembly, in accordance with an exemplary embodiment.

Referring now to FIGS. 16-17, in another embodiment, the stop block 134 may be coupled to the frame 132 with more than one bolt 136. For example, the stop block 134 may include outwardly extending flanges 144 on either end that are each coupled to the frame 132 with a bolt 136 and a washer. The frame 132 may include counterbores 145 for one or both of the flanges 144 to recess the mounting hardware below the contact surface 135 and avoid interference problems between the head of the bolts 136 and the eccentric link side plate 96. Referring now to FIG. 18, in another exemplary embodiment, the stop block 134 may be coupled to the frame 132 with a bolt 136 that engages the main body of the stop block 134, with the bolt recessed in a counterbore 146 in the contact surface 135. A transverse slot 148 may be formed in the stop block 134. If the counterbore 146 is fouled by compacted debris, preventing access to the head of the bolt 136, the bolt 136 may be accessed through the slot 148 to be severed, such as being burned out with a torch.

Figure 19:
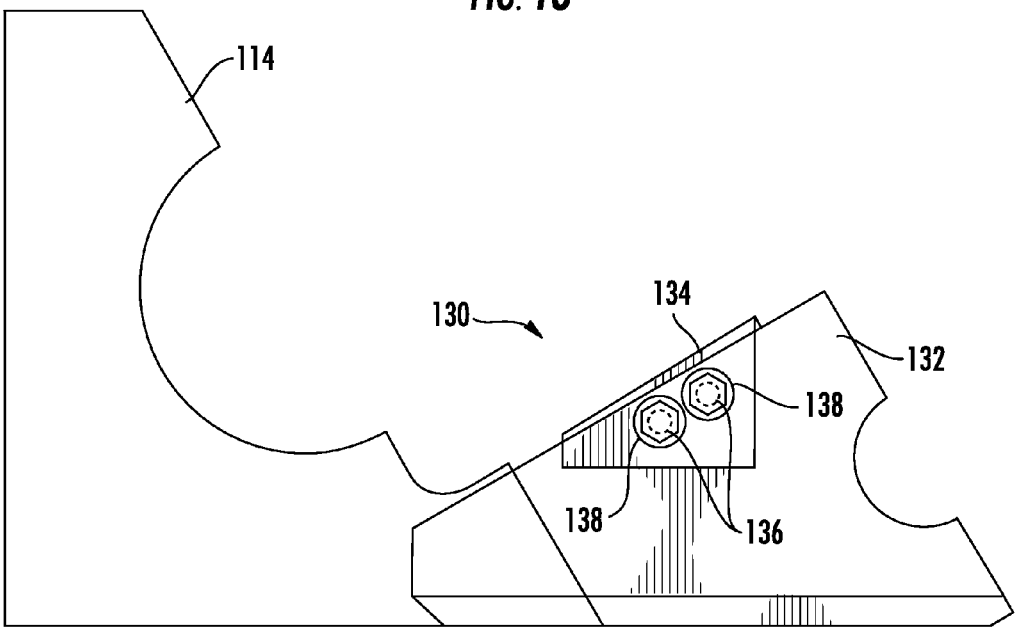
FIG. 19 is a side view of another stop block assembly shown in relation to the eccentric link mounting bracket, in accordance with an exemplary embodiment.
Figure 20:
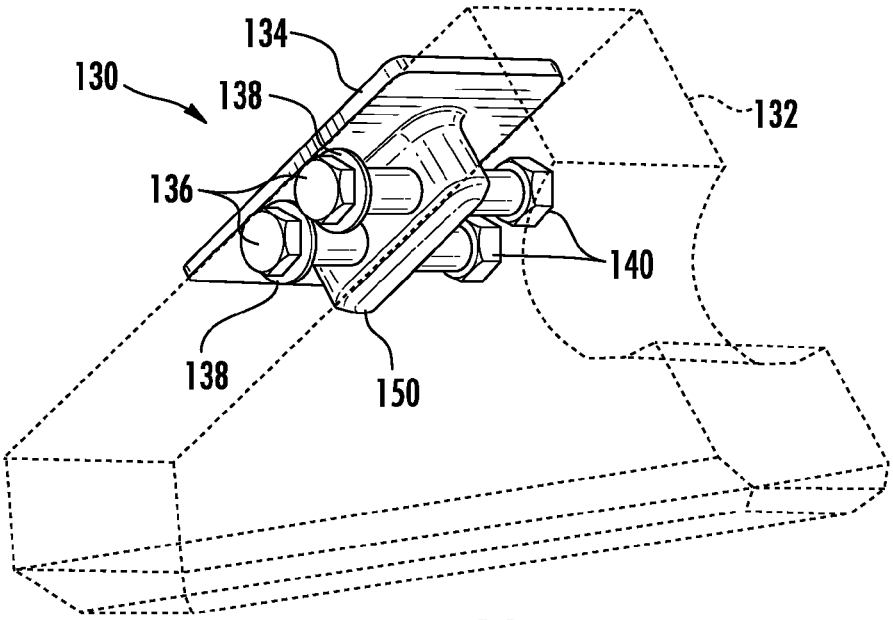
FIG. 20 is a perspective view of the stop block assembly of FIG. 19.
Figure 21:
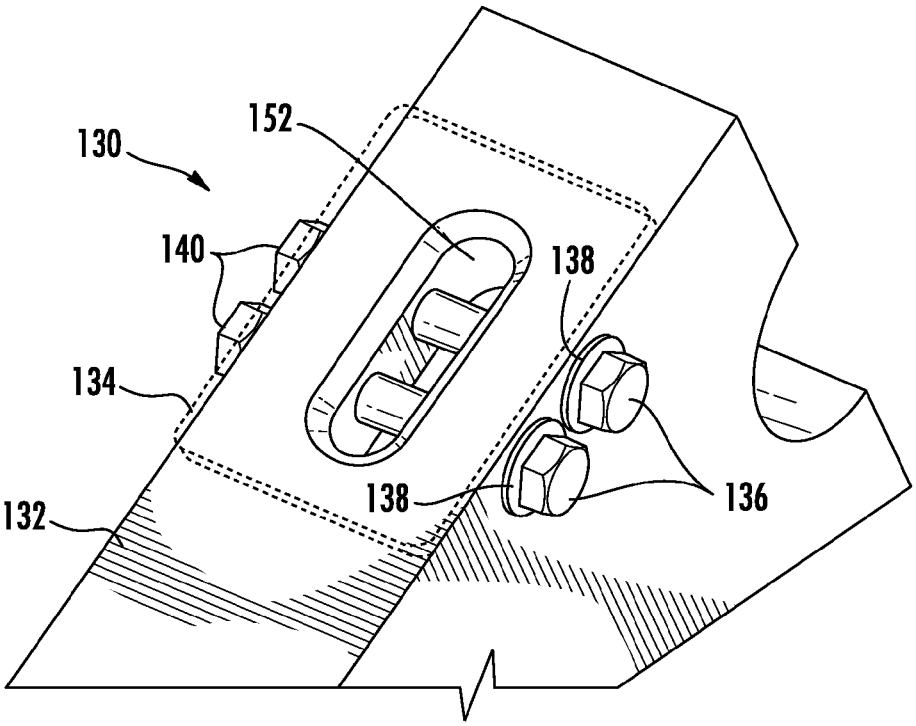
FIG. 21 is another perspective view of the stop block assembly of FIG. 19.

Referring now to FIGS. 19-21, the stop block 134 may include a protrusion 150 that is received in the frame 132. The stop block 134 is coupled to the frame 132 with bolts 136 extending through the frame 132 and the protrusion 150. A transverse slot 152 may be formed in the stop block 134, extending downward from the contact surface 135. The bolts 136 may be retained with washers 138 and nuts 154.

Figure 22:
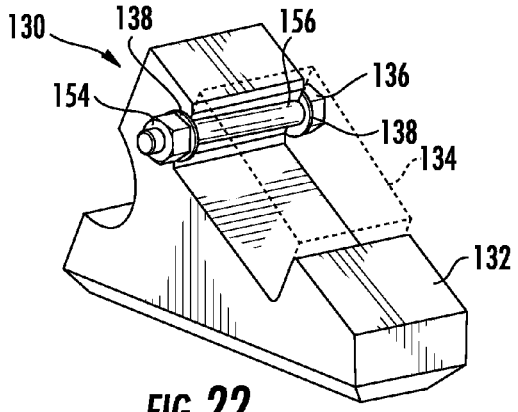
FIG. 22 is a perspective view of another stop block assembly, in accordance with an exemplary embodiment.

Referring now to FIG. 22, the stop block 134 may be coupled to the frame 132 with a bolt 136 that extends through an aperture 156 formed between the frame 132 and a side of the stop block 134. The bolts 136 may be retained with washers 138 and nuts 154.

Figure 23:
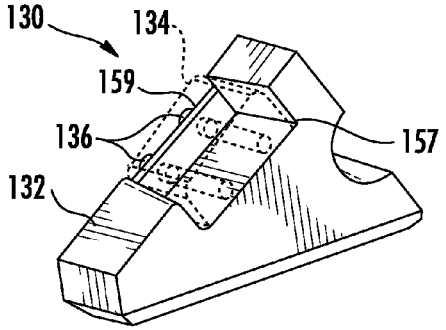
FIG. 23 is another perspective view of a stop block assembly, in accordance with an exemplary embodiment.

Referring now to FIG. 23, the stop block 134 may be a tapered, wedge-shaped body incorporating two dovetail features to lock the stop block 134 in position. The socket 126 is tapered across the thickness of the frame 132. The socket includes a small dovetail feature 157 (e.g., undercut, etc.) at the lower front and rear edges. The narrow end of the stop block 134 is inserted into the socket 126 so that the lower edge dovetails 157 are engaged, impeding upward movement of the stop block 134. A retainer plate 159 and bolts 136 are utilized to draw the dovetails 157 into tight contact and lock the stop block 134 into place. As shown in FIG. 23, the stop block 134 may have a dual taper (one in each direction) across half of it's thickness, allowing the stop block 134 to be inserted in opposite orientations into the tapered socket 126 and allows for a common stop block 134 to be utilized for either the right side or the left side frames 132, which may each have a taper in opposite directions.

Figure 24:
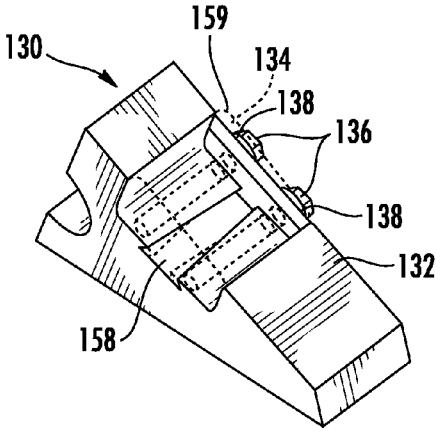
FIG. 24 is a perspective view of another stop block assembly, in accordance with an exemplary embodiment.

Referring now to FIG. 24, the stop block 134 may be a tapered, wedge-shaped body. The narrow end of the stop block 134 is inserted into the socket 126 and the stop block 134 is coupled to the frame 132 with bolts 136. The stop block 134 may engage a dove-tail slot 158 in the frame 132. The retainer plate 159 and the bolts 136 are utilized to draw the dovetail joint between the stop block 134 and the dovetail slot 158 tightly together. The single dovetail at the bottom surface of the socket serve both functions of holding the stop block 134 down in the socket 126 and locking the stop block 134 in place in the front to back direction. The dovetail on the stop block 134 (as shown) may have a half width taper in both directions across its width. This allows the same stop block 134 to be assembled into either a left hand or a right hand mating dovetail groove in the frames 132.

Figure 25:
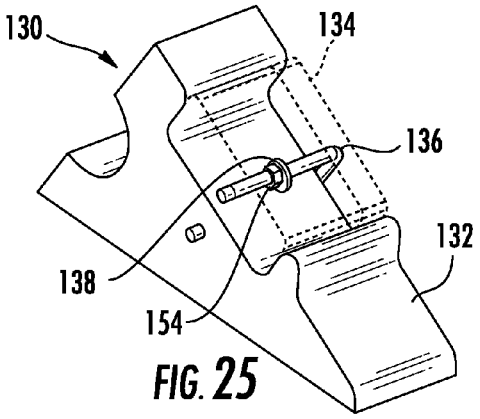
FIG. 25 is a perspective view of another stop block assembly, in accordance with an exemplary embodiment.

Referring now to FIG. 25, the stop block 134 may be coupled to the frame 132 with a U-shaped bolt 136 that extends through an aperture in the frame 132 and an aperture in the stop block 134. The bolts 136 may be retained with washers 138 and nuts 154.

Figure 26:
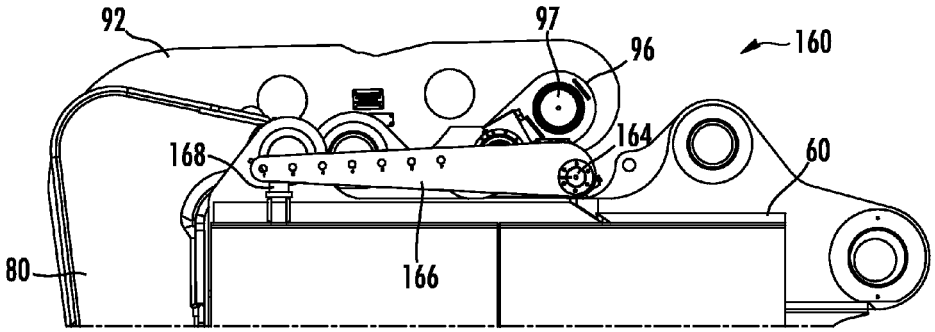
FIG. 26 is a side view of the dipper back showing the trip assembly, in accordance with an exemplary embodiment.
Figure 27:
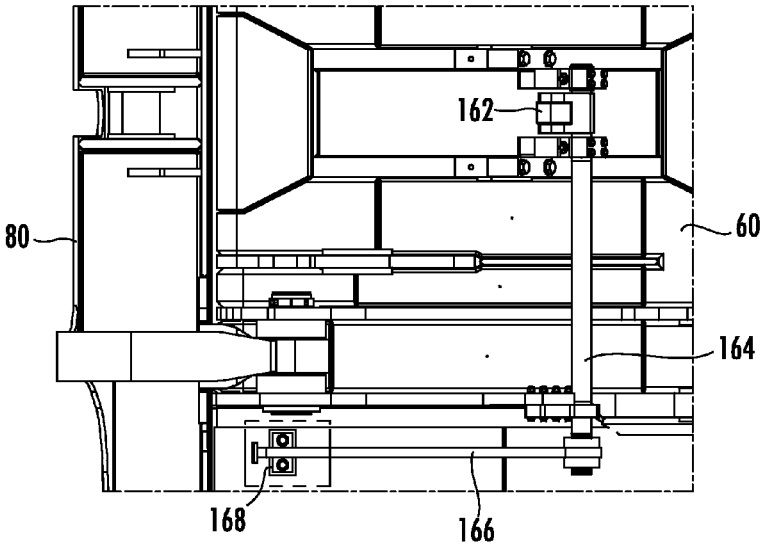
FIG. 27 is a top view of the trip assembly of FIG. 26 with the closure mechanism removed for clarity.
Figure 28:
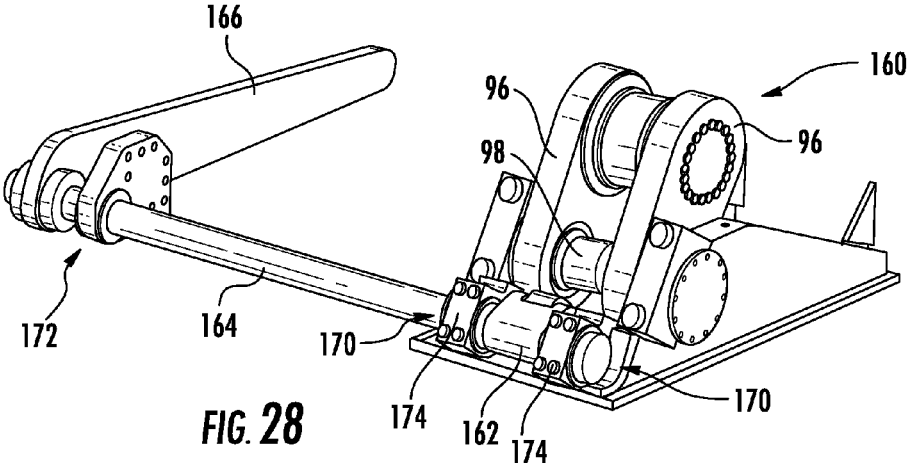
FIG. 28 is a perspective view of the trip assembly of FIG. 26 with a portion of the closure mechanism removed for clarity.

Referring now to FIGS. 26-28, the L-shaped link 92 is rotated upward, away from the dipper back 60 by a trip assembly 160 from the locked position to the unlocked position such that the rotation of the L-shaped link 92 urges the eccentric link side plates 96 back over the over-center position, as described above, such that the axis of rotation of the eccentric link shaft 98 passes between the line extending through the longitudinal axis of the pins 97 and the longitudinal axis of the pin 100 (or the longitudinal axis of inner portion 106 of an eccentric pin assembly 104) and the dipper back wall 60. Once the trip assembly 160 actuates the L-shaped link 92 far enough to rotate the eccentric link side plates 96 past the over-center position, the weight of the dipper door 80 and the contents of the dipper 52 opens the dipper door 80 without further external forces.

The trip assembly 160 includes a cam 162 coupled to a camshaft 164. The camshaft 164 is rotated by a trip arm 166 supported by a bumper assembly 168. The trip arm 166 is with a rope (not shown) coupled to the distal end of the trip arm 166. A force applied to the trip arm 166 by the rope rotates the trip arm 166 upward. The trip arm 166 rotates the camshaft 164, thereby rotating the cam 162 upward to apply a force to the first leg 93 of the L-shaped link 92 and rotate the L-shaped link 92 upward. In other embodiments, the camshaft 164 may be rotated with another actuator, such as a hydraulic actuator acting on a lever arm.

Figure 29:
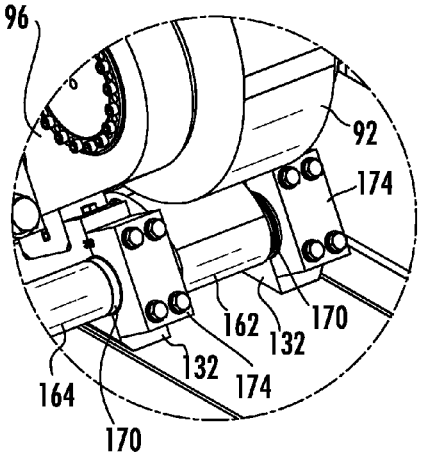
FIG. 29 is a detail perspective view of a portion of the trip assembly of FIG. 26, showing the cam and inboard camshaft support assembly.
Figure 30:
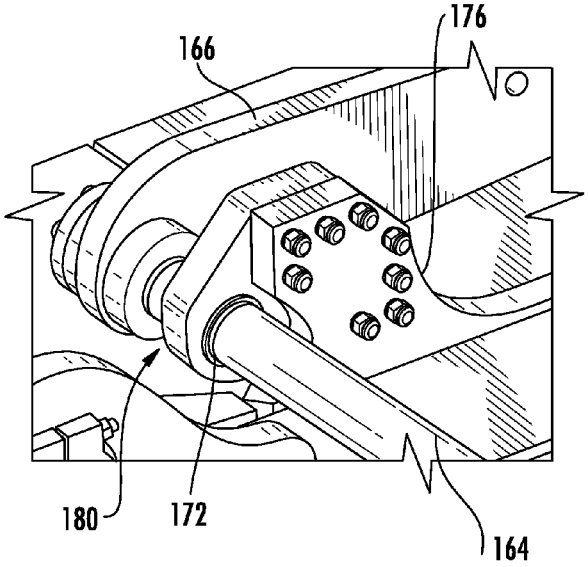
FIG. 30 is a perspective view of a portion of the trip assembly of FIG. 26, showing the outboard camshaft support assembly.

Referring now to FIGS. 29 and 30, the camshaft 164 is rotatably supported by inboard bearings 170 provided on either side of the cam 162 and an outboard bearing 172 coupled to a distal end of the camshaft 164 proximate to the trip arm 166. According to an exemplary embodiment, the inboard bearings 170 are cylindrical bearings coupled to the frames 132 of the stop block assemblies 130 with inboard bearing caps 174. The outboard bearing 172 is a spherical bearing that allows for some misalignment or distortion of the camshaft 164. The outboard bearing 172 is coupled to an outboard camshaft support mount 176 extending upward from the back wall 60 of the dipper 52 with an outboard support assembly 180.

Figure 31:
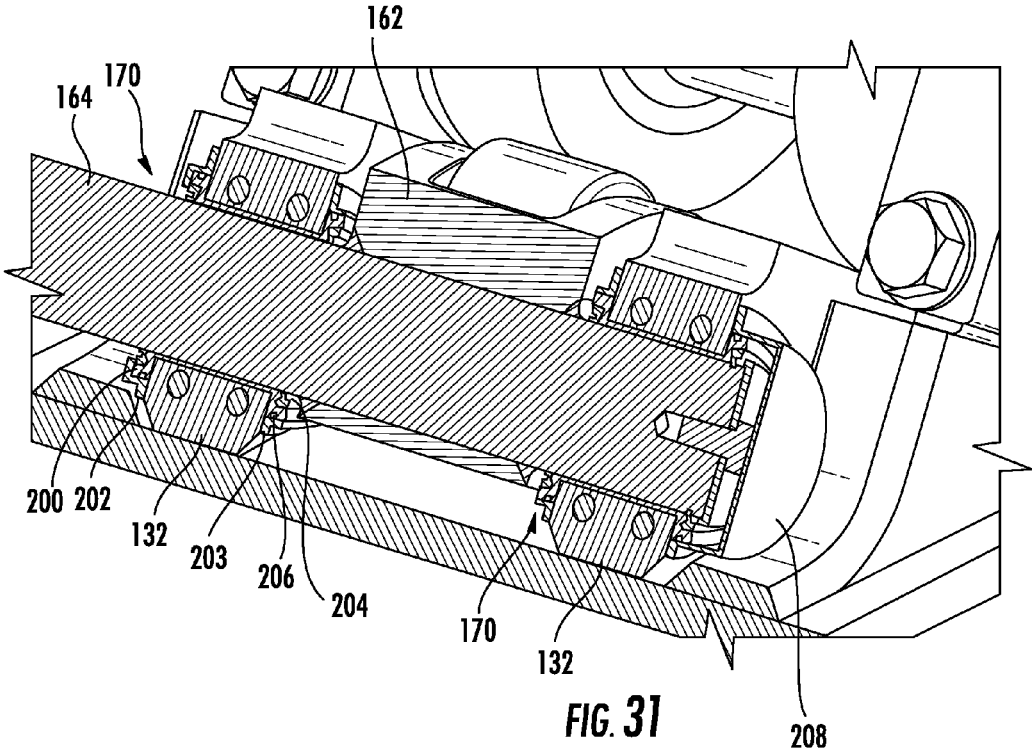
FIG. 31 is a cross-section of a portion of the trip assembly of FIG. 26.

Referring now to FIG. 31, a portion of the trip assembly 160 including the inboard bearings 170 are shown in more detail. The inboard bearings 170 include sealing features that are intended to exclude contaminants (e.g., dust, debris, moisture, etc.) from penetrating into the area of the bearings which support the camshaft 164. According to an exemplary embodiment, the bearings include a main body 200 and sealing flanges 202 and 203. The main body 200 includes flanged ends to facilitate the retention of the bearing 170 in the axial direction of the camshaft 164. The body 200 further includes machined cavities configured to receive seals 204 and 206. The inner seals 204 are rotary seals that contact the outer surface of the camshaft 164. The outer seals 206 are static seal such as o-rings provided between the main body 200 and the sealing flanges 202 and 203. An end cover 208 is coupled to the stop block assembly frame 132 proximate to the inboard end of the camshaft 164 in place of the sealing flange 203 to protect the end of the camshaft 164 from contaminants. The use of sealing features is intended to increase the service life of the bearings by excluding contaminants, which can cause premature wear of the rotating surface of the camshaft 164 and wear of the inside diameter of the bearings 170.

Figure 32:
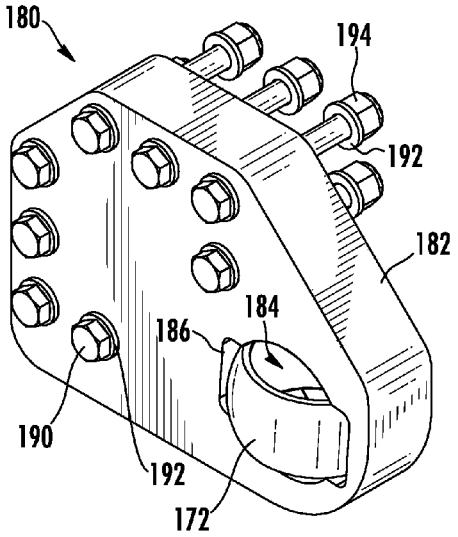
FIG. 32 is a perspective view of an outboard camshaft support assembly of FIG. 30 with the spherical bearing in a first position for installation of the spherical bearing.
Figure 33:
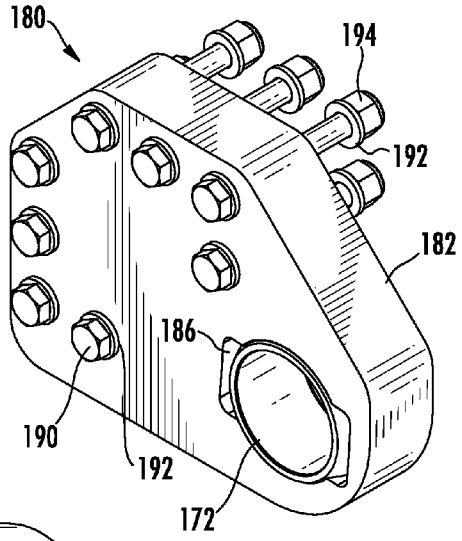
FIG. 33 is a perspective view of an outboard camshaft support assembly of FIG. 30 with the spherical bearing in a second position for operational support of the cam shaft.
Figure 34:
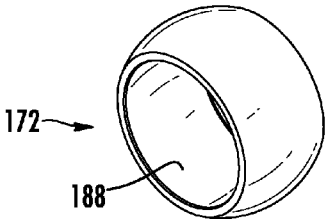
FIG. 34 is a perspective view of the spherical bearing for the support assembly of FIG. 33.
Figure 35:
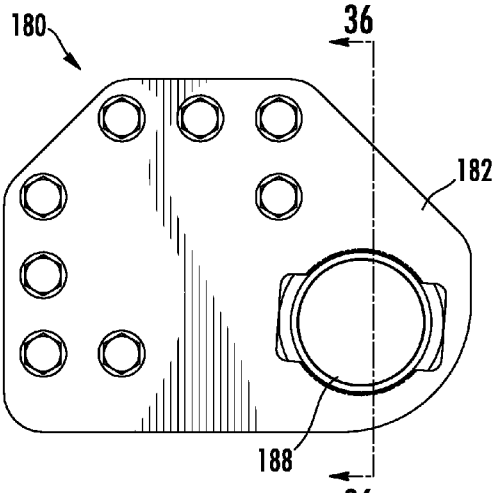
FIG. 35 is a side view of the support assembly of FIG. 33.
Figure 36:
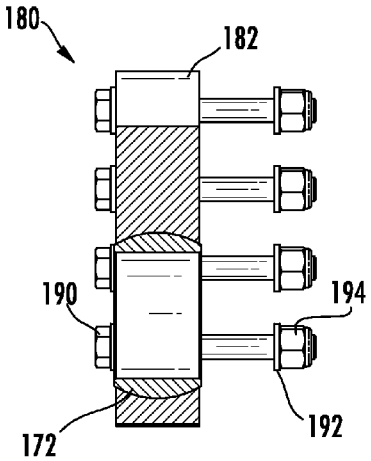
FIG. 36 is a cross-section of the support assembly of FIG. 35, taken along line 36-36.
Figure 37:
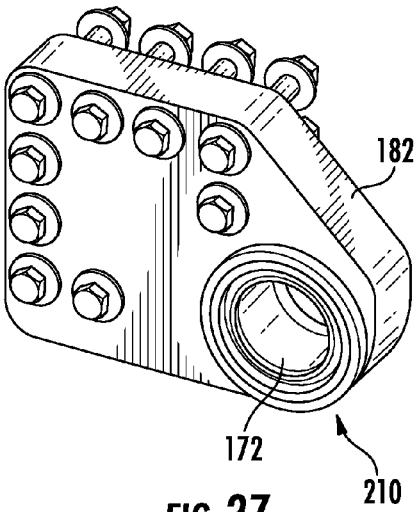
FIG. 37 is a perspective view of a support assembly with a rubber seal, in accordance with another exemplary embodiment.
Figure 38:
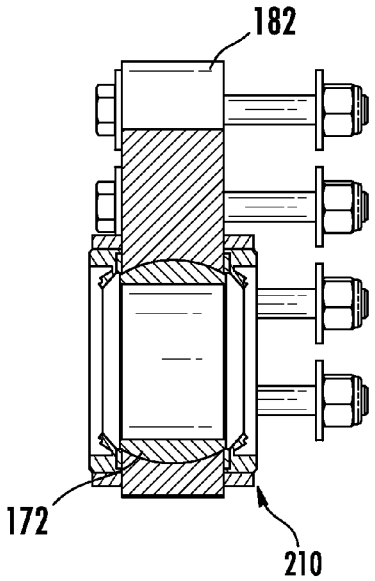
FIG. 38 is a cross-section view of the support assembly of FIG. 37.
Figure 39:
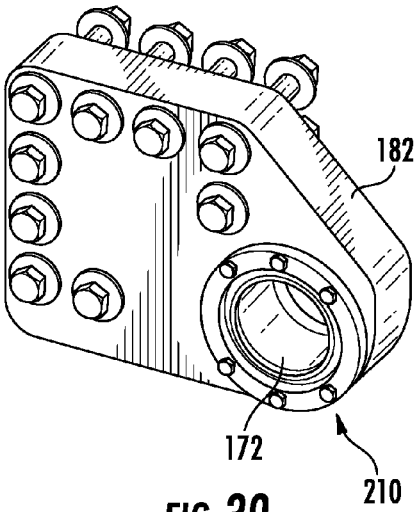
FIG. 39 is a perspective view of a support assembly with a rubber cover seal, in accordance with another exemplary embodiment.
Figure 40:
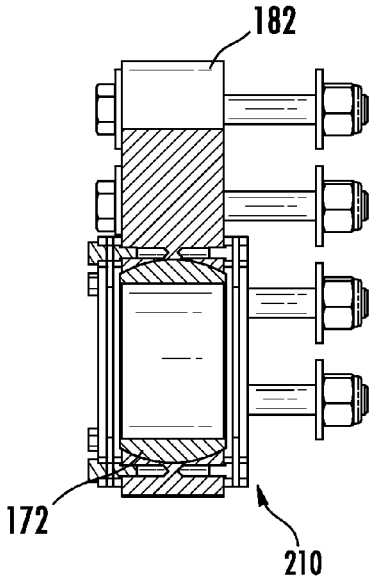
FIG. 40 is a cross-section view of the support assembly of FIG. 39.
Figure 41:
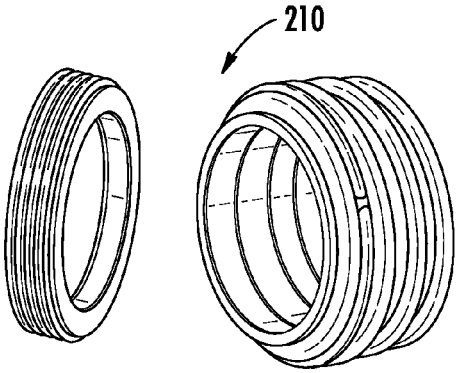
FIG. 41 is a perspective view of mechanical seals for a support assembly, in accordance with another exemplary embodiment.
Figure 42:
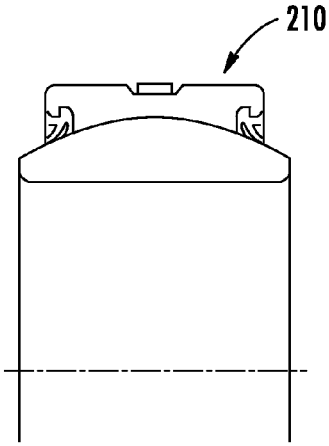
FIG. 42 is a cross-section view of a support assembly with a rubber seal, in accordance with another exemplary embodiment.
Figure 43:
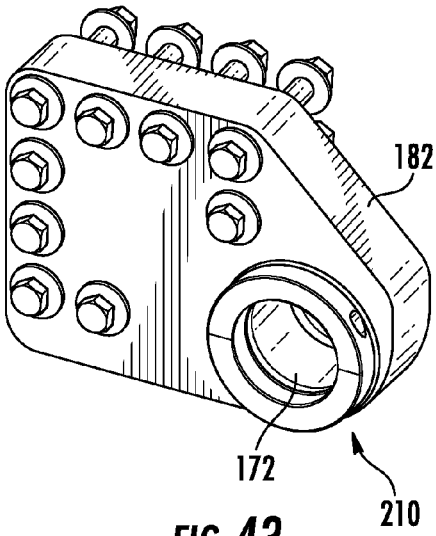
FIG. 43 is a perspective view of a support assembly with a rubber v-ring seal, in accordance with another exemplary embodiment.
Figure 44:
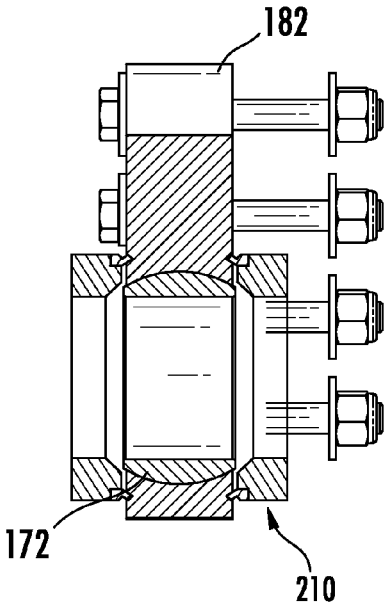
FIG. 44 is a cross-section view of the support assembly of FIG. 43.
Figure 45:
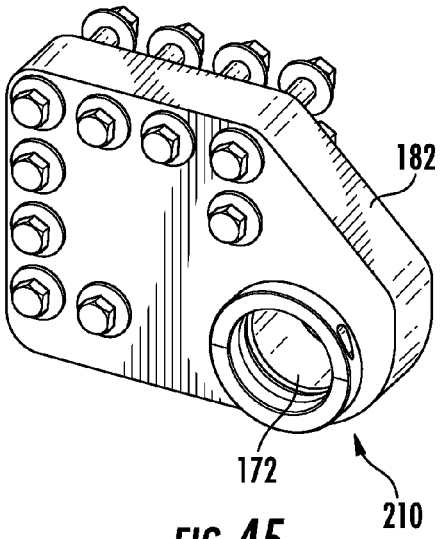
FIG. 45 is a perspective view of a support assembly with a rubber spacer seal, in accordance with another exemplary embodiment.
Figure 46:
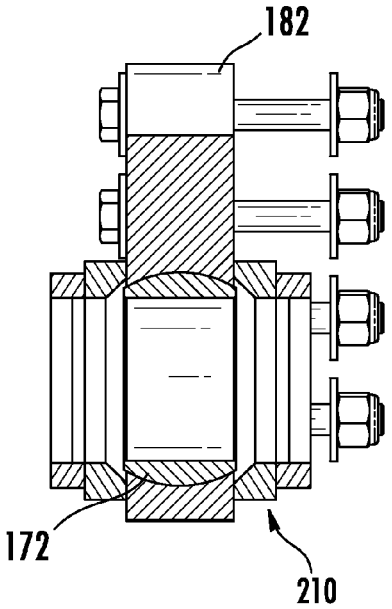
FIG. 46 is a cross-section view of the support assembly of FIG. 45.

Referring now to FIGS. 32-36 the outboard support assembly 180 includes a bearing block 182 with a socket 184 configured to house the spherical bearing member 172. The bearing member 172 is inserted into a widened slot 186, as shown in FIG. 32. Once inserted, the bearing member 172 may be rotated 90 degrees into position, as shown in FIG. 33. The spherical bearing member 172 includes a cylindrical bore 188 for the camshaft 164. The spherical bearing member 172 can be replaced without tools, allowing for greater ease of replacement.

The bearing block 182 is coupled to the outboard camshaft support mount 176 with common fasteners such as bolts 190, washers 192, and nuts 194. The bolts 190 extend through holes in the bearing block 182 and aligned holes in the outboard camshaft support mount 176. To properly align the camshaft 164, the mounting surface face and holes in the outboard camshaft support mount 176 may be machined utilizing the same fixture as used to machine other features associated with the closure mechanism 90 and the trip assembly 160 (e.g., bores 78, sockets 126, etc.). The openings in the bearing block 182 and the outboard camshaft support mount 176 may be oversized to allow for some further adjustment of the outboard bearing 172.

Referring now to FIGS. 37-46, a sealing mechanism 210 may be provided on either side of the bearing block 182. The sealing mechanism 210 impedes the access of dust, moisture, or other debris into the space between the bearing member 172 and the socket 184 of the bearing block 182 and therefore increases the life of the bearing surfaces and the reliability of the bearing. The seal mechanism may be any suitable structure or system that provides a flexible seal around the camshaft 164, such as a rubber lip seal (see FIGS. 37 and 38), a rubber cover seal (see FIGS. 39 and 40), a mechanical seal (see FIG. 41), a rubber seal (see FIG. 42), a rubber v-ring seal (see FIGS. 43 and 44), or a rubber spacer seal (see FIGS. 45 and 46).

By coupling outboard support assembly 180 to the outboard camshaft support mount 176 with fasteners such as bolts 190 instead of with a welding operation, the installation time and overall weight of the outboard bearing 172 can be greatly reduced. Machining the mounting surface and the mounting holes located from associated features such as the bores for the camshaft 164 as defined by the stop block assemblies 130 and inboard camshaft bearing caps 174 allows for a greater precision in the location of the outboard bearing 172.

In the embodiments described above, the closure mechanism 90 for the dipper door 80 is located away from the normal flow of material being dug and dumped by the dipper assembly 50. This results in a high level of reliability. Moreover, the particular self-locking feature of the above described embodiments provides the additional benefit of requiring low forces to release the dipper door 80 from the closed position.

By precisely locating various components of the closure mechanism 90 and the trip assembly 160, the over-center angle of the eccentric link side plates 96 and the locked position of the eccentric link side plates 96 and the L-shaped link 92 may be precisely controlled, improving the reliability of the dipper assembly 50.

Referring now to FIG. 47, the top of the dipper assembly 50, including the closure mechanism 90 and the top of the dipper door 80, is shown according to an exemplary embodiment. A pivoting connector, shown as a y-block connector 230, is provided for securely connecting the trip rope (not shown) to trip arm 166. Y-block connector 230 is intended to provide an easier method for removing and replacing the trip rope when service on the trip rope is required. The weight of y-block connector 230 is also intended to aid in returning trip arm 166 to the rest position on bumper assembly 168.

Figure 48:
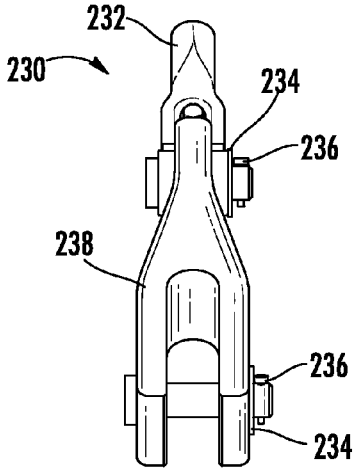
FIG. 48 is an isolated view of a y-block connector for connecting the trip rope to the trip arm, in accordance with an exemplary embodiment.

Referring now to FIG. 48, an isolated view of y-block connector 230 is shown to include a Crosby-type connector 232 used to secure the rope to the y-shaped link 238. The trip rope (not shown) is attached to Crosby-type connector 232 and Crosby-type connector 232 is pinned to one end of y-shaped link 238 by a hardened pin 236 or other suitable connector. The other end of y-shaped link 238 is pinned to trip arm 166 by another hardened pin 236 or other suitable connector. The connections from y-shaped link 238 to Crosby-type connector 232 and trip arm 166 also include hardened bushings 234, which are intended to provide improved durability of the connector for longer maintenance-free operation.

The construction and arrangements of the dipper assembly 50, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed dipper door assembly may be implemented into any mining shovel with a dipper door that must be held closed for any period of time. The disclosed dipper door assembly may help reduce the amount of false door releases or lock failures due to damage from rocks and dirt. The disclosed dipper door assembly may also reduce assembly costs by eliminating the need for a latch mechanism to keep the dipper door closed. The disclosed dipper door assembly may further reduce maintenance costs by curtailing the amount of wear on the dipper door's closure mechanism.

The disclosed dipper door assembly may reduce maintenance costs by providing a trip assembly that is durable, and more easily removable and replaceable than the conventional trip assembly. The disclosed dipper door assembly may also reduce maintenance and service costs by providing a camshaft support assembly having a rotatable and adjustable bearing intended to reduce wear on the assembly. The disclosed dipper assembly may also include a sealing mechanism intended to prevent debris from entering the camshaft support assembly, further reducing maintenance necessary on the assembly.

It will be apparent to those skilled in the art that various modifications and variations can be made to the disclosed dipper door assembly. Other embodiments will be apparent to those skilled in the art from consideration of the specification and practice of the disclosed dipper door assembly. It is intended that the specification and examples be considered as exemplary only, with a true scope being indicated by the following claims and their equivalents.

What is claimed is:

1. A dipper assembly for a mining shovel, comprising:

a dipper having a dipper back and an open dipper bottom;

a dipper door coupled to the dipper for movement between an open position and a closed position;

a closure mechanism configured to retain the dipper door in the closed position;

a trip assembly configured to release the dipper door for movement to the open position, the trip assembly comprising:

a camshaft having a cam, the camshaft and cam configured to rotate in response to a force, and the cam being configured to engage the closure mechanism when rotated;

a trip arm coupled to the camshaft and also configured to be coupled to a trip rope, the trip arm configured to rotate the camshaft and cam when activated by the trip rope;

wherein the closure mechanism is configured to release the dipper door when engaged by the cam;

a camshaft support assembly, comprising:

a bearing block having a socket configured to receive a rotatable bearing member, the rotatable bearing member received by the socket of the bearing block and having a bore configured to receive the camshaft; and a sealing mechanism positioned between the bearing block and the rotatable bearing member, and configured to provide a seal between the bearing block and the rotatable bearing member.

2. The dipper assembly of claim 1, further comprising a pivoting connector configured to couple the trip rope to the trip arm.

3. The dipper assembly of claim 2, wherein the pivoting connector comprises a Y-block connector having a Y-shaped link coupled on a first end to the trip arm and coupled on a second end to a second connector.

4. The dipper assembly of claim 3, wherein the second connector comprises a wire rope connector, a first end of the wire rope connector is coupled to the Y-shaped link, and a second end of the wire rope connector couples the Y-block connector to the trip rope.

5. The dipper assembly of claim 4, further comprising a first pin assembly coupling the Y-shaped link to the wire rope connector, and a second pin assembly coupling the Y-shaped link to the trip arm.

6. The dipper assembly of claim 5, wherein the Y-shaped link comprises one or more hardened bushings configured to receive the first and second pin assemblies.

7. The dipper assembly of claim 5, wherein the first pin assembly comprises a first hardened pin formed to couple the Y-shaped link to the wire rope connector, and the second pin assembly comprises a second hardened pin formed to couple the Y-shaped link to the trip arm.

8. The dipper assembly of claim 1, wherein the sealing mechanism comprises a flexible seal configured to fit around the camshaft.

9. The dipper assembly of claim 1, wherein the rotatable bearing member is spherical and configured to rotate at least 90 degrees within the socket.

10. The dipper assembly of claim 1, wherein the socket of the bearing block is oversized so that the rotatable bearing member can be rotated and/or adjusted.

11. The dipper assembly of claim 1, further comprising a support mount coupled to the dipper back, and one or more locking assemblies configured to couple the camshaft support assembly to the support mount.

12. A camshaft support assembly for a shovel dipper, comprising:

a bearing block coupled to the shovel dipper and having a socket configured to receive a rotatable bearing member;

a rotatable bearing member received by the socket of the bearing block and having a bore configured to receive a camshaft, the camshaft having a cam configured to release a dipper door on the shovel dipper; and a sealing mechanism positioned between the bearing block and the rotatable bearing member, and configured to provide a seal between the bearing block and the rotatable bearing member.

13. The camshaft support assembly of claim 12, wherein the sealing mechanism comprises a flexible seal configured to fit around the camshaft.

14. The camshaft support assembly of claim 12, wherein the rotatable bearing member is spherical and configured to rotate at least 90 degrees.

15. The camshaft support assembly of claim 12, wherein the socket of the bearing block is oversized so that the rotatable bearing member can be adjusted within the socket.

16. The camshaft support assembly of claim 12, further comprising a support mount coupled to the shovel dipper, and one or more locking assemblies configured to couple the bearing block to the support mount.

17. A trip assembly for a shovel dipper having a dipper door, comprising:

a camshaft having a cam configured to release the dipper door;

a trip arm having a first end coupled to the camshaft and a second end configured to be coupled to a trip rope, the trip arm configured to move in response to a force applied by the trip rope, thereby rotating the camshaft and cam, and allowing the dipper door to open;

a Y-shaped link having a first end coupled to a connector by a first pin assembly, and having a second end coupled to the trip arm by a second pin assembly;

wherein the connector comprises a wire rope connector and has a first end coupled to the Y-shaped link and a second end configured to be coupled to the trip rope;

wherein the Y-shaped link comprises one or more hardened bushings configured to receive the first and second pin assemblies.

18. The trip assembly of claim 17, wherein the first pin assembly comprises a first hardened pin formed to couple the Y-shaped link to the wire rope connector, and the second pin assembly comprises a second hardened pin formed to couple the Y-shaped link to the trip arm.

* * * * *